US007118355B2

(12) United States Patent
Lipa, III et al.

(10) Patent No.: US 7,118,355 B2
(45) Date of Patent: Oct. 10, 2006

(54) ELECTRIC MOTOR DRIVEN BLOWER ASSEMBLY WITH INTEGRAL MOTOR COOLING DUCT

(75) Inventors: Theodore Lipa, III, Lockport, NY (US); Kristain J Hagen, Gasport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/052,484

(22) Filed: Feb. 4, 2005

(65) Prior Publication Data

US 2006/0177322 A1 Aug. 10, 2006

(51) Int. Cl.
*F04B 17/03* (2006.01)
*F04B 39/06* (2006.01)

(52) U.S. Cl. ..... 417/370

(58) Field of Classification Search ..... 417/366, 417/369, 370

See application file for complete search history.

(56) References Cited

U.S. PATENT DOCUMENTS 5,743,721 A * 4/1998 Graham et al. ..... 417/370
6,034,451 A 3/2000 El Mayas ..... 310/63
6,283,726 B1 * 9/2001 Fackelmann et al. ..... 417/366
6,406,275 B1 * 6/2002 Hoehn ..... 417/366
6,604,906 B1 * 8/2003 Ozeki et al. ..... 417/370
6,802,699 B1 * 10/2004 Mikami et al. ..... 417/369
7,011,506 B1 * 3/2006 Kim ..... 417/369

FOREIGN PATENT DOCUMENTS

JP 5-106596 * 4/1993

* cited by examiner

*Primary Examiner*—Michael Koczo, Jr.
(74) *Attorney, Agent, or Firm*—Patrick M. Griffin

(57) ABSTRACT

An electric motor driven blower assembly provides for a complete air cooling duct running from the inside of the blower housing to the motor at the back of the housing. A vertical cooling tube on the scroll housing is mated to an open, moldable trough in the motor cover across a sealing projection on a vibration gasket. The seal of the vertical tube through the gasket provides a right angle turn in the cooling duct, providing a complete cooling duct while still allowing all parts to be easily molded.

4 Claims, 4 Drawing Sheets

ELECTRIC MOTOR DRIVEN BLOWER ASSEMBLY WITH INTEGRAL MOTOR COOLING DUCT

TECHNICAL FIELD

This invention relates to automotive air conditioning system blowers, and particularly to an improved housing for the drive motor that provides an integral cooling duct for the electric drive motor.

BACKGROUND OF THE INVENTION

Typical automotive heating, ventilation and air conditioning modules (HVAC modules) include an electric driven centrifugal fan that spins within a scroll housing to pull unconditioned air from outside (or inside) the vehicle and blow it toward and through a series of heat exchangers and air flow control valves before introduction into the passenger cabin. While the projecting electric motor shaft turns the centrifugal flower, it's main body and heat producing coils are encased within a motor holding that is bolted to the back of the scroll housing, and not directly exposed to any cooling air flow. A cooling air flow for the motor is desirable for motor durability. A conventional motor cooling means often seen in production is a simple tube that runs from an air inlet opening at a high air pressure point within the scroll housing, outside of the housing and around to and through the back of the motor cover, so as to feed a constant cooling air stream to the motor. The cooling tube, though effective, represents an extra part and assembly step, with the consequent extra cost. A cooling tube of this basic type may be seen in U.S. Pat. No. 6,034,451, FIG. 2.

In order to eliminate the extra part, at least some portion of the cooling tube has been molded integrally into the motor cover itself. An inherent problem with the molding operation, however, at least with a simple mold that has no movable cores, is that any duct so formed will inevitably be left open on one side, and will need to be closed off by some other operation and part. This is especially true at the "elbow" of the duct, that is, that portion of the duct that turns the corner and moves radially inwardly toward the back of the motor cover. A known method of so "closing off" and completing the otherwise open duct, while still maintaining moldability of the motor cover as a whole, is shown in FIG. 1. There, a molded motor cover A has an integral, trough shaped duct B, to the end of which is molded an extra flap C, attached by an integral hinge D. Flap C can be folded back over the end of integral duct B, closing off the end thereof while leaving a rectangular window E (in flap C) open. When motor cover A is then bolted to the back of the non illustrated fan scroll, window E can be abutted with another duct formed in the scroll housing to complete a cooling air path from inside the scroll housing, through the window E and ultimately to the motor housing. A drawback of this structure, beyond the extra assembly step of folding over the flap C, is that the abutment of the duct to window E is one of hard plastic to hard plastic, with relatively little tolerance for molding or assembly irregularities at the direct interface.

SUMMARY OF THE INVENTION

The subject invention provides an alternative structure for providing an integral motor cooling air passage, with better sealing and higher tolerance at the joint.

In the preferred embodiment disclosed, a cylindrical air supply tube molded integrally to the outside of the fan scroll housing extends from a lower end exposed to the air stream to an upper end above the back of the scroll fan housing, generally parallel to the blower axis. Fan pressurized air can enter the inlet of the tube and exit the upper end, but needs to turn 90 degrees and move radially inwardly to reach the motor. A motor holding cover adapted to be bolted to the back of the scroll housing has a trough shaped duct integrally molded therein, which extends radially to an outer end beyond the basic perimeter of the motor cover. The cooling tube is located so that its upper end projects into the end of the open trough when the motor cover is bolted to the scroll housing. A separate, elastomer vibration absorbing gasket surrounds the perimeter of the motor cover, to be captured between the cover perimeter and the scroll housing when attached. A projection on the gasket overlies the end of the open trough, with a central window through which the upper end of the air supply tube tightly and sealingly inserts when the motor cover is bolted in place. The extra gasket material provides the transitional corner from the scroll housing cooling tube into the motor cover, and provides a tight, high tolerance seal. No extra parts, and no extra assembly steps are required.

DESCRIPTION OF THE PREFERRED EMBODIMENT

Figure 1:
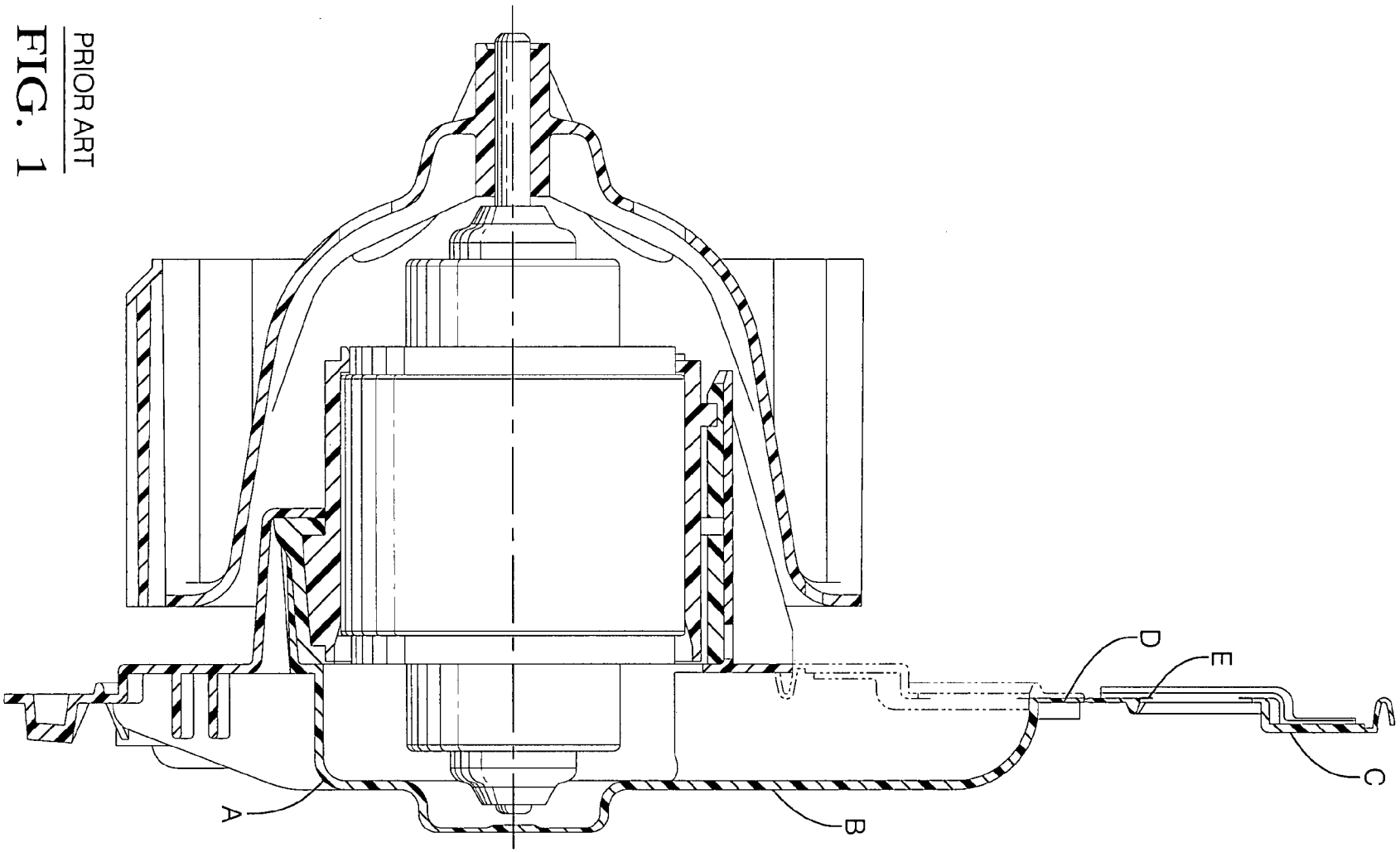
PRIOR ART FIG. 1
FIG. 1 is a partial cross sectional view of a prior art design.
Figure 2:
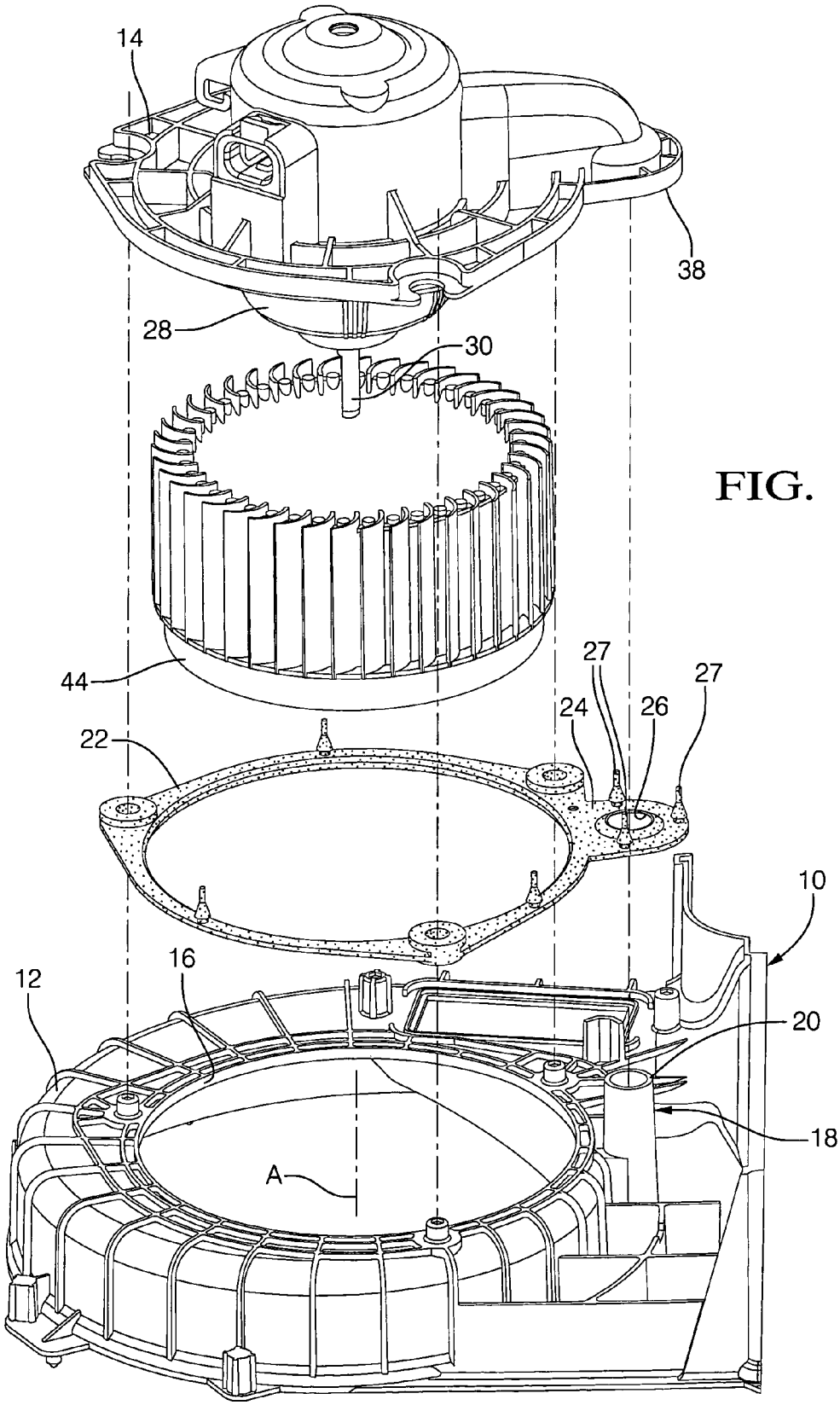
FIG. 2 is an exploded perspective view of a preferred embodiment of the invention.

Referring first to FIG. 2, a preferred embodiment of the invention includes an HVAC case, indicated generally at 10, an integral part of which is a fan or blower scroll housing 12, the outside of which is shown. Scroll housing 12 receives a motor holding cover 14 bolted to and through an open side defined by a circular cutout 16. So mounting motor cover 14 both closes the cutout 16 and locates a blower 44 coaxial to the central axis A of circular cutout 16, within housing 12. The blower 44 pulls outside or re circulated inside air into housing 12 and blows it into the rest of HVAC case 10. At a high air pressure point within housing 12, a cylindrical cooling tube 18 extends parallel to the central axis A from a non visible inlet end past the plane of the cutout 16 to an upper end 20. Essentially all the visible features of case 10 and scroll housing 12, including the cooling tube 18, are amenable to simple and cost effective by-pass molding, by a single pair of mold elements that part along a line parallel to the central axis A. Cooling tube 18 is inevitably located radially outboard of the scroll housing 12 interior and, being straight and parallel to the central axis A, is not capable of carrying air radially inwardly back to the interior. It cannot "turn the corner," in effect, and still be moldable by the desired technique. Before motor cover 14 is bolted to and through the scroll cutout 16, a rubber isolator gasket, indicated generally at 22, is interposed between the motor cover 14 and the edge of the cutout 16. Gasket 22 dampens motor and blower vibrations from being translated directly to the scroll housing 12 and the rest of case 10. In the preferred embodiment of the invention, an additional radial edge projection 24, with a central, circular window 26 is provided. Projection 24 is unrelated to the basic vibration isolation purpose of gasket 22. Window 26 is sized to fit tightly over the cooling tube upper end 20. Surrounding window 26 are three elastic barbs 27 that serve a purpose described below.

Figure 3:
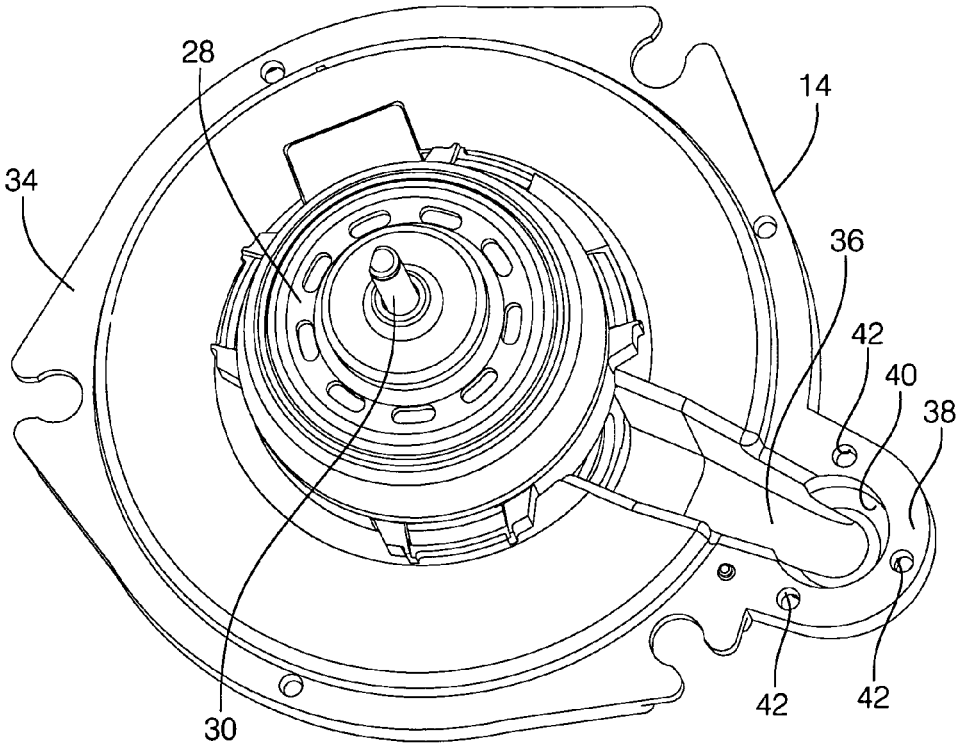
FIG. 3 is a view of the inside of the motor and cover, without the gasket.
Figure 4:
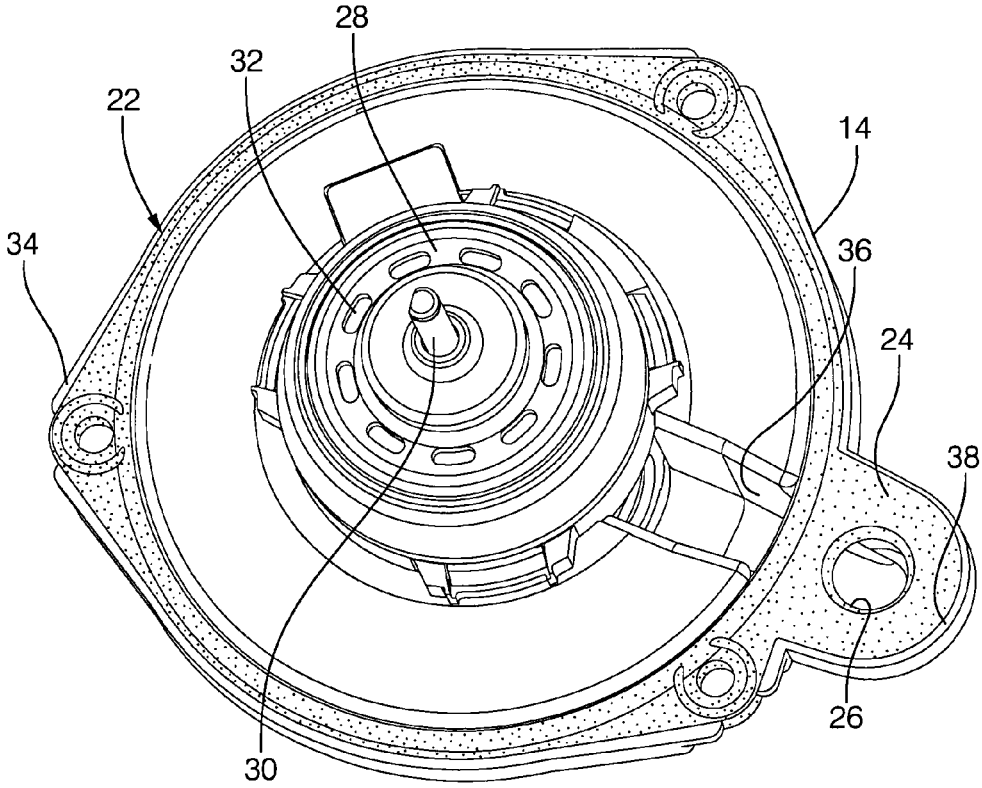
FIG. 4 is a view of the inside of the motor and cover with the gasket.

Referring next to FIGS. 3 and 4, the inside of motor cover 14 is illustrated. Cover 14 holds a conventional electric motor 28, which has a central, blower driving shaft 30 (coaxial to axis A) and an outer sleeve 32 that is ventilated to receive cooling air, if it is available. An inset peripheral rim 34 of motor cover 14, concentric to and larger in diameter than scroll housing cut out 16, defines a plane, normal to the central axis. Rim 34 also positions and holds gasket 22 for proper installation location, as shown in FIG. 4. As best seen in FIG. 3, molded integrally into the body of cover 14 is an open trough 36 that extends from the motor sleeve 32, generally normal to the axis of the motor shaft 30, radially past the rim 34 to an outer end bordered by a projecting flange 38 coplanar to rim 34. Flange 38 contains a circular lead-in 40 that matches the diameter of gasket window 26. Trough 36 alone, however, being inevitably open on one side, is incapable alone of forming a complete, four sided air duct. Surrounding lead-in 40 are three holes 42 in flange 38 that receive the gasket barbs 27 to help hold gasket 22 in place, flat against the flange 38 with the gasket window 26 aligned with lead-in 40. As with HVAC case 10, essentially all the visible features of motor cover 14, as well, can be by-pass molded. It should be noted that these assembly steps are identical to those that would be carried out simply by mounting a conventional motor cover and gasket. No extra steps, fasteners or components are needed, apart from snapping the barbs 27 through the holes 42.

Figure 5:
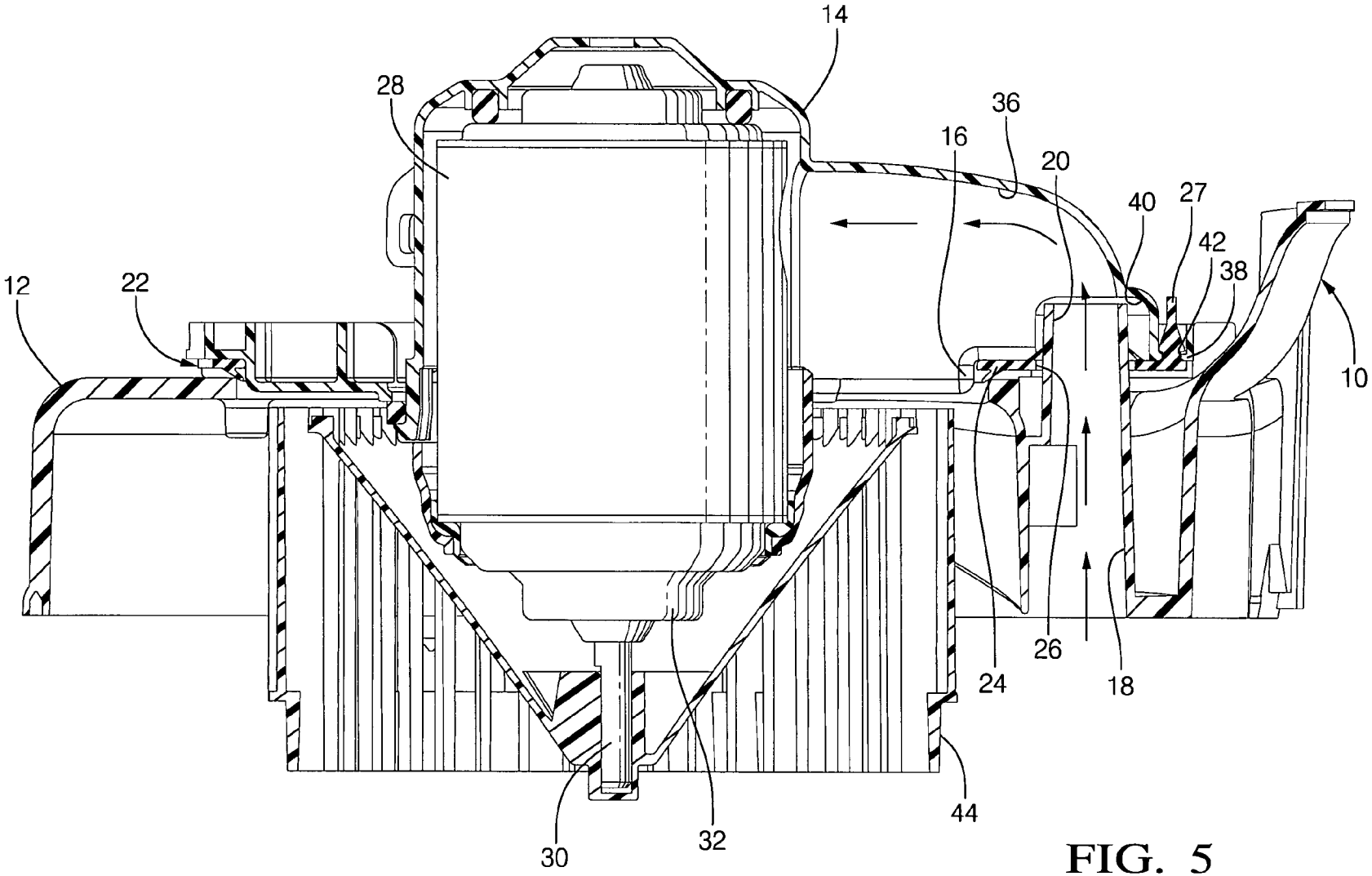
FIG. 5 is a cross sectional view of the housing and motor cover showing the air flow path.

Referring next to FIGS. 2 and 5, when cover 14 is bolted to and through the scroll housing cut out 16 to enclose it, the motor shaft 30 axis is moved generally coaxial to the central axis of cut-out 16, parallel to the cooling tube 18. By circumferentially registering the gasket window 26 to the cooling tube upper end 20, it is assured that the cooling tube upper end 20 simultaneously and automatically is inserted tightly through gasket window 26, and also enters the trough lead-in 40. The rest of gasket 22 is compressed between the motor cover rim 34, surrounding the scroll housing circular cut-out 16. As shaft mounted blower 44 spins, a portion of the pressurized air stream enters the lower end of cooling tube 18, leaves the tube upper end 20 and passes through the tight fitting gasket window 26. Now the air stream can "turn the corner" provided by the gasket projection 24 overlaying the end of trough 36. Once through the gasket projection 24 and past the boundary of gasket 22, the air stream has no available path for back flow into cooling tube 18, and flows to and through the ventilated motor sleeve 32, exiting in the lower pressure zone beneath blower 44. In this manner, cooling tube 18, trough 36 and gasket 22 cooperate to form a cooling duct to supply a continuous stream of cooling air so long as blower 44 is turning.

Beyond the advantage of requiring no extra components or significant extra assembly steps, an advantage of the structure disclosed is that the seal provided by the close axial insertion of the cooling tube 18 through the gasket window 26 is both tighter and more tolerance friendly than a hard plastic to hard plastic abutting interface, as noted above. Variations in the preferred embodiment disclosed could be made. Tube 18 need not absolutely be molded in one piece with the scroll housing 12. Alternatively, for example, a separate round tube of the same size and orientation could be glued or spun welded through a hole in the scroll housing 12, as a retrofit to an existing design that it was desired not to re tool. Regardless, it will be, in practical effect, an integral part of the scroll housing 12 before assembly of the motor cover 14 The round shape of tube 18 is not strictly necessary, any shape matching a similarly shaped window through the gasket projection 24 would function as well. If desired, the projection 24 could be lengthened so as to overlay the remainder of the open side of trough 36, closing it off all the way up to the motor sleeve 32. The gasket barbs 27 may not be absolutely necessary, but help assure that the gasket 22 is not stretched out of place when the cooling tube 18 inserts through window 26.

The invention claimed is:

1. In an electric motor driven blower assembly having a motor shaft mounted blower positioned in a surrounding blower housing having a central axis and an open side closed by the attachment of a separate motor holding cover to said blower housing at a generally planar peripheral rim, a cooling duct for the motor that forms an integral part of both the blower housing and the motor cover, comprising, a cooling tube integrally formed with the blower housing, and extending generally parallel to the central axis, axially beyond the peripheral rim to an upper end, an open trough integrally formed with said motor cover and extending radially past said peripheral rim to an outer end, an elastomer gasket located on and surrounding said peripheral rim and having a projection overlaying the outer end of said open trough, with a window sized to tightly receive the upper end of said cooling tube, whereby, when said motor cover is attached with the gasket window and cooling tube in circumferential registration, the end of the cooling tube is inserted closely through the gasket projection window, thereby completing a cooling air duct from the blower housing into the motor cover.

2. A blower assembly according to claim 1, further characterized in that said cooling tube is integrally molded with said blower housing.

3. A blower assembly according to claim 2, further characterized in that said cooling tube is cylindrical.

4. A blower assembly according to claim 1, further characterized in that said open trough outer end is bordered by a flange co-planar with the motor cover peripheral rim, and said flange is abutted to said gasket projection.

* * * * *